United States Patent [19]

Weider

[11] Patent Number: 4,569,105

[45] Date of Patent: Feb. 11, 1986

[54] CLIP ON COLLAR FOR DUMBELLS AND BARBELLS

[75] Inventor: Joseph Weider, Los Angeles, Calif.

[73] Assignee: Weider Health & Fitness, Woodland Hills, Calif.

[21] Appl. No.: 225,192

[22] Filed: Jan. 15, 1981

[51] Int. Cl.[4] ..... B42F 1/00

[52] U.S. Cl. ..... 24/488; 24/544; 24/550; 24/567; 272/123

[58] Field of Search ..... 272/123, 122, 124, 143, 272/93; 24/252 R, 263 SB, 338, 261 R, 256, 257, 448, 544, 523, 550, 567, 499–511, 546–556

[56] References Cited

U.S. PATENT DOCUMENTS

| | | | |
|---|---|---|---|
| D. 31,972 | 12/1899 | Carter | 24/550 X |
| 69,288 | 9/1867 | Wells et al. | 24/488 |
| 1,270,034 | 6/1918 | Krudop | 272/123 |
| 2,147,963 | 2/1939 | Casciotti | 24/554 |
| 2,874,430 | 2/1959 | Coldren | 24/256 X |
| 3,298,074 | 1/1967 | Kedem | 24/257 R |
| 3,576,341 | 4/1971 | Hammon | 24/261 R X |
| 3,675,275 | 7/1972 | Arblaster | 24/261 R X |
| 3,726,522 | 4/1973 | Silberman | 272/123 |
| 3,825,253 | 7/1974 | Speyer | 272/123 |

FOREIGN PATENT DOCUMENTS

| | | | |
|---|---|---|---|
| 746875 | 3/1956 | United Kingdom | 24/488 |

*Primary Examiner*—Richard J. Apley
*Assistant Examiner*—William R. Browne
*Attorney, Agent, or Firm*—Blakely, Sokoloff, Taylor & Zafman

[57] ABSTRACT

A compact collar for securing weights to a barbell. The collar utilizes a spring coil, restrained against maximum tightening, thereby setting a minimum internal diameter of the coil. A pair of outwardly extending angularly displaced arms that can be moved towards each other to reduce the tightness of the coil, thereby increasing the internal diameter of the coil and permitting it to slip over the end of a barbell. Once in place, the release of the arms, allows the natural spring tendency to tighten the coil and grip the barbell, thus holding the weights in place.

2 Claims, 2 Drawing Figures

CLIP ON COLLAR FOR DUMBELLS AND BARBELLS

PRIOR ART STATEMENT

The only prior art of which applicant is aware comprises the well known solid metal collar of generally conical or cylindrical shape, secured to the bar by a set screw of one sort or another.

SUMMARY OF THE INVENTION

The collar comprises a coil of heavy gauge wire with the inner diameter of the coil, in its free state, being slightly smaller than the outside diameter of the bar on which it is to be placed. Each end portion of the wire is bent outwardly from the coil to provide arms which may be grasped and moved toward one another to loosen the tightness of the coil and thus slightly increase the inner diameter of the coil permitting it to be easily slipped over the bar. When the arms are released, the natural spring quality of the coil will increase the tightness of the coil to reduce the interior diameter of the coil and secure the coil to the bar. A pivoted hook is secured to the free end of one of the arms and its hooked portion engages the free end of the other arm and restrains it against inadvertent operation. The hook also keeps the two arms from separating too far from one another when the coil is not in use on the bar so that the arms may be easily and comfortably operated.

DETAILED DESCRIPTION OF THE INVENTION

Figure 1:
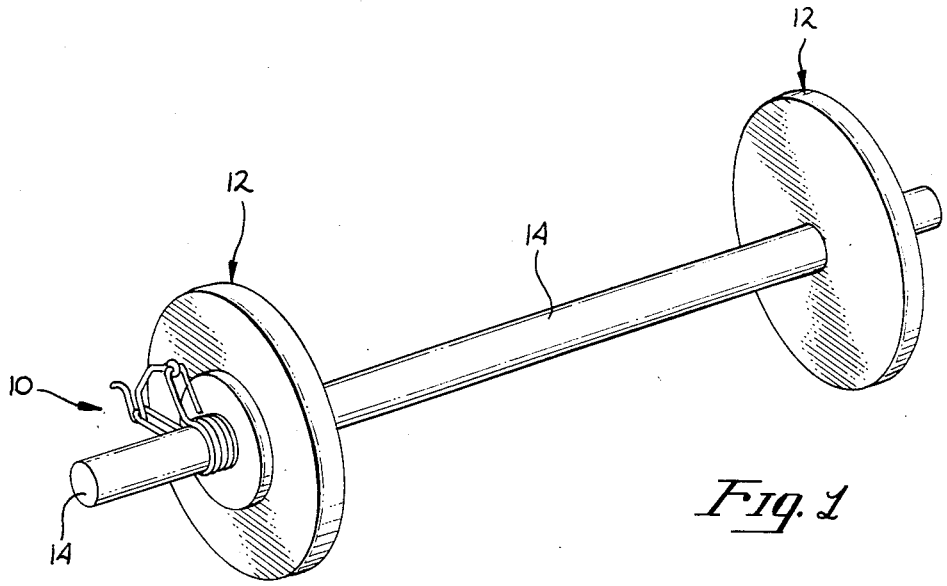
FIG. 1 shows the collar in use and in place on the bar to retain the weights on the bar.

The collar 10, of the present invention, is used to secure weights 12 in place upon a dumbell or barbell 14 such as shown in FIG. 1. The collar replaces the usual solid metal collar normally held in place by a set screw. The present collar is very compact and is preferably made of polished chrome for maximum visual appeal.

The collar 10 consists of a hook member 20 and a coil member 30. The coil member 30 is formed from a length of heavy gauge polished chrome wire. The middle portion of the wire is formed into a cylindrical coil 32 and each end portion is formed into a looped arm, such as arm 34 and arm 36. Each arm 34 and 36 is bent so that it extends radially outward from the coil 32 and is generally perpendicular thereto. Each arm forms a loop. Arm 34 forms a loop defined by lengths 34*a* and 34*b* which are parallel to one another with a curved portion 34*c* joining the lengths at their radially outward end. Similarly arm 36 forms a loop defined by lengths 36*a* and 36*b* which are parallel to one another with a curved portion 36*c* joining the lengths at their radially outward end.

Figure 2:
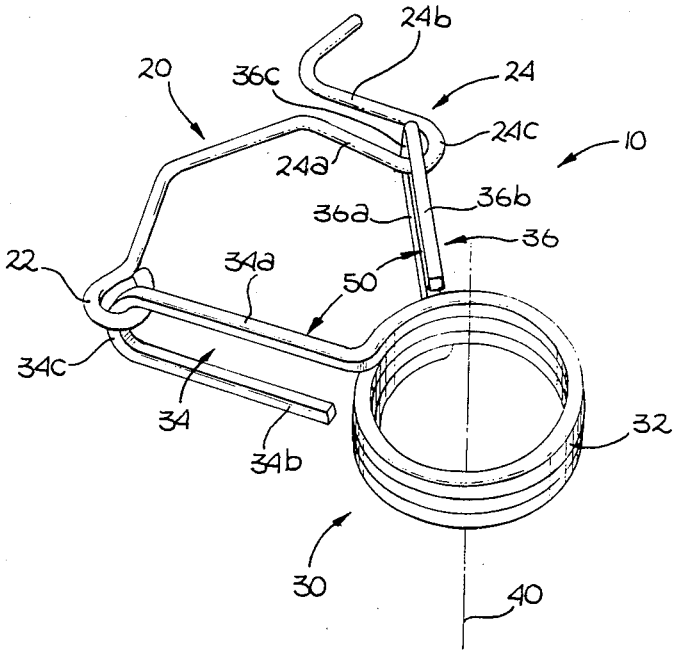
FIG. 2 shows an enlarged and detailed perspective of the collar.

The arms 34 and 36 are designed for comfort and ease of operation. It should be noted that arm 34, which is integrally formed from the top end of coil 32 as shown in FIG. 2, has its second length 34*b* located directly beneath its first length 34*a*. Similarly arm 36, which is integrally formed from the bottom end of coil 32 as shown in FIG. 2, has its second length 36*b* located directly above its first length 36*a*. Thus, if arms 34 and 36 were rotated about axis 40, toward one another, the perimeter of arms 34 and 36 would be coincident. The axial distance spanned by the arms 34 and 36 is preferably equal to, and certainly not greater than, the axial distance spanned by coil 32. This configuration insures compactness in the axial direction and minimize discomforting torque or twisting that would result, if the arms 34 and 36 were axially displaced with respect to each other, when operating the collar. Because of this axially compact configuration, an additional weight may be placed on each end of bar 14 as compared to the number of weights which can be retained by presently used collars.

In the free state, the spring qualities of the coil 32 of collar 10 would tend to angularly separate arms 34 and 36 by an angle greater than angle 50 shown in FIG. 2. As angle 50 increases, it requires more effort to move the arms 34 and 36 back to the same separation and the efficiency of the effort exerted is reduced (i.e., the forces exerted on the arms 34 and 36 are even further from being coaxial). To prevent angle 50 from becoming uncomfortably large when the collar is not in use, e.g., is on a shelf or floor, a hook member 20 is used. When hook member 20 is not used, angle 50 should be substantially less than approximately $360°(n)+180°$, where n is the number of loops comprising coil 32, each loop providing 360° of angular separation between the arms. If angle 50 is close to or greater than $360°(n)+180°$, then a simple one handed method of placing the subject collar clip on a bar cannot be easily accomplished.

Hook member 20 is also preferably formed of heavy gauge polished chrome wire. At one end hook member 20 is formed to provide an eye 22 and, at the other end, is formed to provide a latching hook 24. The latching hook 24 is formed by generally straight (but slightly curving) portions 24*a* and 24*b* joined at their radially inner ends by curved portion 24*c*. The generally straight portions 24*a* and 24*b*, as shown in the position of FIG. 2, slope radially inwardly with increasing angular separation of arms 34 and 36. Hook member 20 is engaged with the radially outer end of each arm 34 and 36 and thus restrains the angular separation of arms 34 and 36. The hook member 20 is secured at one end by eye 22 to the curved portion (34*c* or 36*c*) of one of the arm members (34 or 36) and its hook 24 loops about the curved portion (36*c* or 34*c*) of the other arm (36 or 34). The natural spring tendency of coil 32 tends to cause the curved portion of an arm to seat itself in the bottom of the hook 24, i.e., at the curved portion 24*c*.

When not in use, the collar 10 would appear as shown in FIG. 2. The angular separation of arms 34 and 36 is restrained to a desired maximum. Thus, the diameter of coil 32 in at a minimum, which is less than the diameter of a bar 14. In order to place collar 10 onto bar 14, the arms 34 and 36 are moved toward one another, decreasing angle 50 and increasing the internal diameter of coil 32. Angle 50 is decreased until the internal diameter of coil 32 is large enough to allow the collar 10 to slip over an end of bar 14. The collar 10 is slid against a weight 12 and the arms 34 and 36 are released. The natural spring tendency of coil 32 increases the angular separation of arms 34 and 36. The internal diameter of coil 32 thus decreases until it reaches the external diameter of bar 14 and retains weights 12 in place. To remove the weights 12 and collar, the procedure is reversed. The arms 34 and 36 are moved toward one another, increasing the internal diameter of coil 32, allowing collar 10 to be slipped off of bar 14.

Once the collar 10 is in place on a bar 14, the hook member 20 serves no purpose, and for large diameter bars 14, the arms 34 and 36 may be moved toward one another to such an extent that the hook member 20 will dangle loosely, with hook 24 not engaging an arm. Of course, as the collar 10 is removed from such a bar 14 of large diameter, one should be sure to engage hook 24 with the curved portion 34*c* or 36*c* of the appropriate arm to restrain the maximum angular separation of the arms 34 and 36.

While the collar 10 has been described with particular reference to FIGS. 1 and 2 it should be understood that many changes, both as to material and structure, may be made to the collar by one of ordinary skill in the art, without departing from the spirit and scope of the invention. The figures and discussion are for illustration of the invention only and should not be viewed as limitations upon the scope of the invention as defined by the appended claims.

What is claimed is:

1. A collar for securing weights upon a bar, said collar comprising:

a generally cylindrical coil formed intermediate the ends of a wire;

a first end of said wire forming a first arm extending radially outward from said coil;

a second end of said wire forming a second arm extending radially outward from said coil and angularly displaced from said first arm about the axis of said coil; and a hook means for releasably coupling the radially outward ends of said first and second arms thereby restraining said arms against angular separation beyond a desired maximum, said first arm comprising a radially extending loop lying in an axially exending plane with the free end of said wire of said loop lying proximate said second end of said coil and proximate the exterior surface of said coil; and said hook means comprising a wire member having an eye at one end thereof and a latch hook at the other end thereof;

whereby said eye may be slipped over the free end of one arm and moved to the radially outer end of said arm, and said latch hook may be engaged with the radially outer end of said second arm whereby angular separation of said arms is restrained to the desired maximum.

2. A collar according to claim 1 wherein said latch hook comprises a first and second generally straight and parallel lengths, each of said lengths sloping radially inwardly with increased angular separation of said first and second arms, said first and second lengths being joined by a curved portion at their radially inwardly ends.

* * * * *